United States Patent [19]

Barbour

[11] 3,954,056

[45] May 4, 1976

[54] PLATEN POSITIONING MEANS FOR IMPRINTERS

[75] Inventor: William P. Barbour, Gaithersburg, Md.

[73] Assignee: Control Data Corporation, Minneapolis, Minn.

[22] Filed: Apr. 9, 1975

[21] Appl. No.: 566,560

[52] U.S. Cl. ..... 101/269; 101/283; 29/129

[51] Int. Cl.[2] ..... B41F 3/04; B41F 3/56

[58] Field of Search ..... 101/269, 45, 282–285; 29/129

[56] References Cited

UNITED STATES PATENTS

| | | | |
|---|---|---|---|
| 2,730,771 | 1/1956 | Beck et al. | 29/129 |
| 2,909,811 | 10/1959 | Naegeli | 29/129 |
| 3,577,917 | 5/1971 | Nantz | 101/269 |
| 3,650,209 | 3/1972 | Allport | 101/269 |
| 3,705,548 | 12/1972 | Waterman | 101/269 |
| 3,810,424 | 5/1974 | Barbour | 101/269 |
| 3,814,015 | 6/1974 | Ozaki et al. | 101/269 |
| 3,862,598 | 1/1975 | Hawthorne | 101/269 |
| 3,893,393 | 7/1975 | See | 101/269 |

*Primary Examiner*—Edgar S. Burr
*Assistant Examiner*—William Pieprz
*Attorney, Agent, or Firm*—Robert M. Angus

[57] ABSTRACT

A roller platen imprinter is provided with means for selectively raising and lowering the roller platen for the imprinting and return strokes. The said means includes regions on the platen shaft of different sectional dimensions, together with cam means for axially shifting the support position of the shaft between the portion having the large sectional dimension and the portion having the smaller sectional dimension to selectively raise and lower the platen.

12 Claims, 3 Drawing Figures

PLATEN POSITIONING MEANS FOR IMPRINTERS

Figure 1:
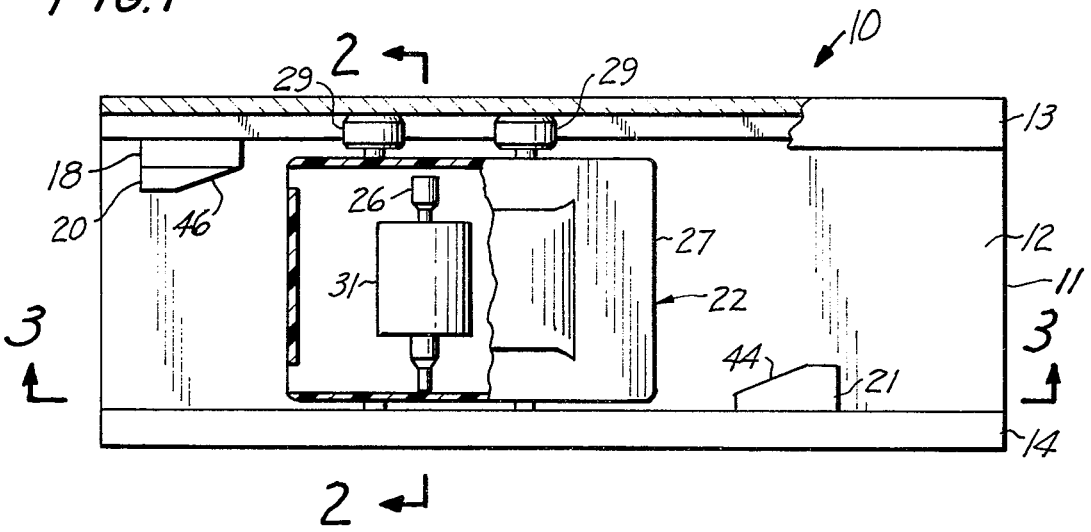

This invention relates to imprinters, and particularly to apparatus for raising a roller platen to move it from a print elevation during a return stroke, and for lowering the platen to the print elevation in readiness for a print stroke.

Roller platen imprinters are used by merchandisers in connection with credit sales of merchandise and services. Imprinters ordinarily employ a bed capable of supporting a suitable print means, such as fixed or portable print plates and/or a set of movable print figures. A sheet set to be imprinted is placed on the bed over the print means and a roller platen is passed over the assemblage to imprint characters on the sheet by bearing against the sheets. Examples of such roller platen imprinters may be found in my prior U.S. Pat. Nos. 3,538,848 and 3,810,424.

Many imprinters operate on the so-called "two-stroke" principle, namely one in which the imprinting stroke is occasioned by movement of a carriage supporting the roller platen in one direction across the sheet or sheet set and a return stroke in the opposite direction to return the carriage to its original position. To avoid a double print impression on the sheet or sheet set, most prior imprinters have utilized complex lever mechanisms for raising the roller platen upon completion of the imprint stroke so that during the return stroke the roller platen is elevated from the sheet set. The complex lever mechanisms utilized for raising and lowering the roller platen in prior imprinters rendered such imprinters more delicate and more susceptable to requiring adjustment than has been desirable, and in addition rendered such imprinters costly to manufacture.

In my aforementioned U.S. Pat. No. 3,810,424, there is disclosed an imprinter in which the lever mechanisms for raising and lowering the roller platen were completely eliminated and impression was occasioned by a single stroke in either direction along the bed of the imprinter. While the device described in said aforementioned patent was highly successful, some customers nevertheless required an imprinter operating on two strokes, an imprinting stroke and a return stroke.

The present invention is particularly concerned with a two stroke imprinter wherein the roller platen is raised and lowered by a simple yet effective structure.

It is an object of the present invention to provide a two stroke imprinter having a reliable mechanism for raising and lowering the roller platen for the imprinting and return stroke of the carriage.

It is another object of the present invention to provide a two stroke imprinter more reliable and less costly than prior two stroke imprinters.

It is yet another object of the present invention to provide a two stroke imprinter wherein the platen is supported on a shaft having portions of relatively large and small diameters with support means for supporting the shaft and means for shifting the position of the shaft with respect to the support means so that the shaft is selectively supported at its large and small diameters, thereby raising and lowering the roller platen.

In accordance with the present invention a roller platen imprinter includes a roller platen attached to a shaft having portions of large and small sectional dimensions. Bias means biases the shaft against a suitable support means. As the carriage is moved along the bed, suitable cam means cams the shaft from a position of support at one sectional dimension to a position of support at another sectional dimension. Thus, for example, when the shaft is supported at its relatively large sectional dimension, the roller platen is positioned in the lower position to accomplish an imprinting stroke, whereas when the shaft is supported at its smaller sectional dimension the bias means biases the shaft upwardly to raise the roller platen to an elevation so that imprinting will not occur.

One feature of the present invention resides in the fact that the moving parts for the mechanism to raise and lower the roller platen are minimized.

Figure 2:
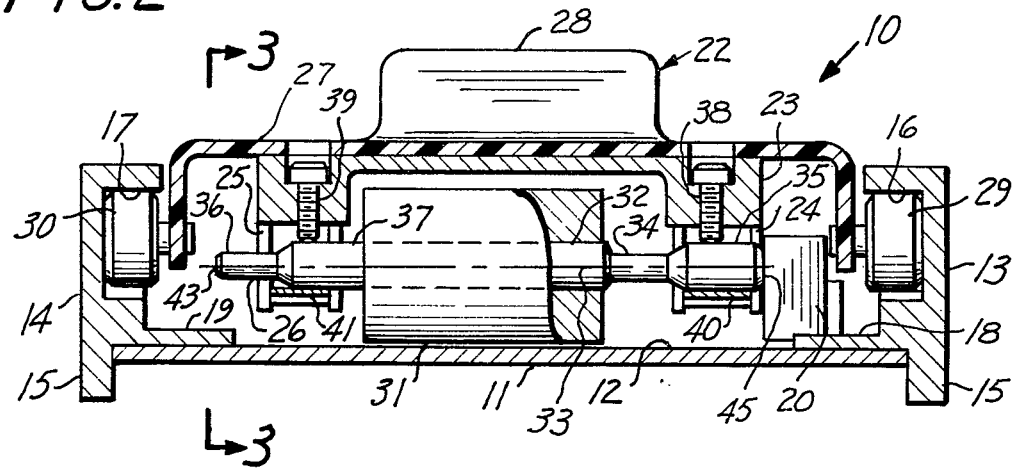
Figure 3:
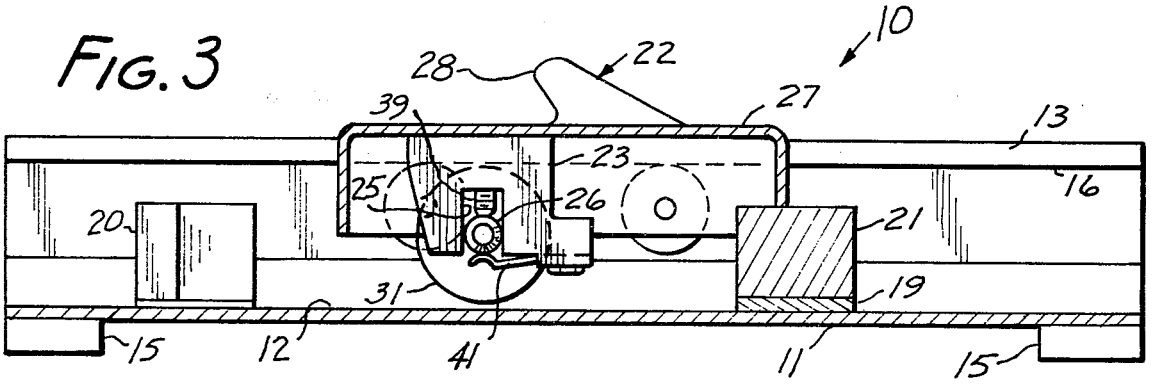

The above and other features of this invention will be more fully understood from the following detailed description and the accompanying drawings, in which:

FIG. 1 is a plan view, partly in cut-away cross-section of an imprinter according to the presently preferred embodiment of the present invention;

FIG. 2 is a section view of the imprinter shown in FIG. 1 taken at line 2—2 in FIG. 1; and FIG. 3 is a section view of the imprinter taken at line 3—3 in FIGS. 1 and 2.

With reference to the drawings, there is illustrated an imprinter 10 in accordance with the presently preferred embodiment of the present invention. Imprinter 10 includes a base 11 forming a flat bed surface 12. Wall members 13 and 14 are attached to base 11 and may, for example, include suitable feet 15 for support of the imprinter. Wall members 13 and 14 preferrably include a suitable channel forming a horizontal surfaces 16 and 17 against which the wheels of the carriage will track, and a flange 18, 19 for support of suitable cam mechanisms 20 and 21, respectively.

Carriage 22 includes a suitable bracket 23 having U-shaped openings 24 and 25 at its end portions for receiving shaft 26 of the roller platen assembly. Preferrably, carriage 22 includes a suitable housing 27 enclosing the roller platen and mechanisms, which housing may also include a suitable handle 28 to assist in manual operation of the device. Wheels 29 and 30 are journaled to housing 27 to track against surfaces 16 and 17 respectively of walls 13 and 14. The force or load occasioned by reaction between the roller platen and characters on the print means is transferred to the carriage and distributed by wheels 29 and 30 to the wall members 13 and 14.

Roller platen 31 is journaled to shaft 26 and is slidably attached to portion 32 of shaft 26. Shaft 26 extends axially along axis 33 beyond the bounds of platen 31 in such a manner that at one end shaft 26 includes a portion 34 of reduced diameter and a portion 35 of larger diameter, and likewise the opposite end of shaft 26 includes a portion 36 of reduced diameter and a portion 37 of increased diameter. Portion 37 may, as shown in FIG. 3, be a continuation of portion 32. Bearing screws 38 and 39 are attached to bracket 23 to bear against shaft 26. Leaf springs 40 and 41 are fastened to bracket 23 and bear against shaft 26 opposite respective ones of bearing screws 38 and 39.

In operation of the imprinter, suitable print means (not shown) are placed on bed surface 12. Such print means, may for example, be suitable dealer plates fixedly attached to surface 12, or may be suitable portable credit cards which may be positioned on surface 12 and held by suitable brackets not shown. In either case, the print means has raised character surfaces adapted to bear against a suitable sheet or sheet set positioned over the print plate means. Of course, it is to be understood that other suitable print means, such as movable characters etc. may also be incorporated to imprint other data onto the sheet or sheet sets.

During the imprint stroke, the position of the roller platen is as shown in the Figures such that the selectively large diameter portions 35 and 37 of shaft 26 bear against bearings screws 38 and 39 and the shaft is biased to that position by the leaf springs 40 and 41. As the carriage supporting the roller platen is moved through its imprinting strokes, the roller platen bears against the sheets to be imprinted at the region of the raised character surfaces on the print means to imprint characters in the sheets. Upon completion of the imprinting stroke, and near the end of travel of the carriage 22, end 43 of shaft 26, which acts as a cam operator, bears against cam surface 44 of cam 21, thereby axially biasing shaft 26 to slide the shaft along its axis to a position such that the sections of reduced diameter 34 and 36 are opposite bearing screws 38 and 39. In such a condition, leaf springs 40 and 41 bias the shaft to a raised position, thereby raising the roller platen to an elevation so that it will clear the sheet set and print means on bed 12 during the return stroke.

During the return stroke (to the left in FIGS. 1 and 3) the roller platen thus is elevated to clear the print plate means so as to avoid double impression of the data from the print means to the sheet or sheet set. Near the end of travel to the left in FIGS. 1 and 3, the cam operator formed by end 45 of shaft 26 cams off cam surface 46 of cam 20 thereby axially shifting shaft 26 back to the position illustrated in FIGS. 1–3 and lowering the roller platen in readiness for another print stroke.

The present invention thus provides an imprinter capable of accomplishing an imprinting operation during an imprinting stroke wherein a simple mechanism is provided for accomplishing raising of the roller platen to avoid imprinting during the return stroke. Quite obviously numerous modifications will be apparent to those skilled in the art, such as the use of several rollers platens on a single shaft to accomplish imprinting at various locations on a sheet or sheet set as well as the use of an imprinter utilizing multiple roller platens on respective shafts. Further, the precise hardware for accomplishing support of the carriage between wheels 29 and 30 and tracks 16 and 17 may be any suitable mechanism capable of suitable support for the carriage to adequately transfer loads occasioned during imprinting. Likewise, while the cam mechanisms are illustrated as operating against cam operators formed by the opposite ends of shaft 26, it is also contemplated that a single cam operator may be attached to shaft 26 to operate against a single cam mechanism.

It will be appreciated that bearing screws 38 and 39 fixedly position an upper surface of shaft 26 with respect to bed surface 12 of base member 11. Upon movement of shaft 26 between its first position wherein screws 38 and 39 bear against an upper surface of sections 35 and 37 and its second position wherein the bearing screws bear against an upper surface of sections 34 and 36, the axis 33 of shaft 26 is vertically repositioned to selectively raise and lower roller platen 31. It will also be appreciated that since the vertical position of roller platen 31 is determined by screws 38 and 39, that position may be selectively adjusted by screws 38 and 39 to achieve optimum pressure for imprinting purposes.

This invention is not to be limited by the embodiments shown in the drawings and described in the description, which are given by way of example and not of limitation, but only in accordance with the scope of the appended claims.

What is claimed is:

1. An imprinter comprising: a base member having a bed portion for supporting a print device and a sheet over said print device, said print device being of the class having raised character surfaces; a carriage journaled to said base member for movement through an imprinting stroke in one direction and for movement through a return stroke in the opposite direction along said base member; a shaft having an axis, saiad shaft being supported by said carriage for movement with said carriage along said base member and also for axial movement relative to said carriage along said axis; cylindrical roller platen means supported by said shaft in coaxial relation to the shaft axis, for bearing against said sheet when said carriage is moved through said imprinting stroke and supported by said shaft in spaced relation to said sheet when said carriage is moved through said return stroke; said shaft having a first surface portion located a first predetermined distance from said axis and having a second surface portion located a second predetermined distance from said axis, one of said first and second distances being less than the other of said second and first distances; cam means supported by said base member for axially moving said shaft between first and second axial positions; and locating means supported by said carriage for bearing against said first surface portion of said shaft when said shaft is in its first axial position and for bearing against said second surface portion of said shaft when said shaft is in its second axial position to selectively raise and lower the axes of said shaft and roller platen means in relation to said bed portion.

2. Apparatus according to claim 1 wherein said cam means includes first and second cam mechanisms each having a cam surface, said cam mechanisms being supported by said base member at respective ends of said imprinting and return strokes, and cam operator means on said shaft for camming against said cam surfaces to move said shaft between its first and second axial positions.

3. Apparatus according to claim 2 wherein said cam operator means comprises the ends of said shaft.

4. Apparatus according to claim 1 wherein said locating means comprises adjustable means supported by said carriage for bearing against said first and second surfaces of said shaft, and bias means biasing said shaft against said adjustable means.

5. Apparatus according to claim 4 wherein said adjustable means are threaded fasteners.

6. Apparatus according to claim 4 wherein said cam means includes first and second cam mechanisms each having a cam surface, said cam mechanisms being supported by said base member at respective ends of said imprinting and return strokes, and cam operator means on said shaft for camming against said cam surfaces to move said shaft between its first and second axial positions.

7. Apparatus according to claim 6 wherein said cam operator means comprises the ends of said shaft.

8. Apparatus according to claim 1 wherein said first surface portion comprises a plurality of cylindrical regions having a first diameter and said second surface portion comprises a plurality of cylindrical regions having a second diameter smaller than said first diameter.

9. Apparatus according to claim 8 wherein said locating means comprises a plurality of adjustable means supported by said carriage for bearing against said regions having said first diameter when said shaft is in its first axial position and for bearing against said regions having said second diameter when said shaft is in its second axial position, and bias means for biasing said shaft against said adjustable means.

10. Apparatus according to claim 9 wherein said adjustable means are threaded fasteners.

11. Apparatus according to claim 9 wherein said cam means includes first and second cam mechanisms each having a cam surface, said cam mechanisms being supported by said base member at respective ends of said imprinting and return strokes, and cam operator means on said shaft for camming against said cam surfaces to move said shaft between its first and second axial positions.

12. Apparatus according to claim 11 wherein said cam operator means comprises the ends of said shaft.

* * * * *